US008083931B2

(12) United States Patent
McCoy et al.

(10) Patent No.: US 8,083,931 B2
(45) **Date of Patent: *Dec. 27, 2011**

(54) UPGRADING OF TAR USING POX/COKER

(75) Inventors: James N. McCoy, Houston, TX (US); Paul F. Keusenkothen, Houston, TX (US); Alok Srivastava, Allsworth Park (SG); James E Graham, Baytown, TX (US)

(73) Assignee: ExxonMobil Chemical Patents Inc., Houston, TX (US)

( * ) Notice: Subject to any disclaimer, the term of this patent is extended or adjusted under 35 U.S.C. 154(b) by 414 days.

This patent is subject to a terminal disclaimer.

(21) Appl. No.: 11/881,063

(22) Filed: Jul. 25, 2007

(65) Prior Publication Data

US 2008/0083649 A1 Apr. 10, 2008

Related U.S. Application Data

(60) Provisional application No. 60/841,657, filed on Aug. 31, 2006.

(51) Int. Cl.
*C10G 57/00* (2006.01)
*C10G 27/04* (2006.01)

(52) U.S. Cl. ..... 208/67; 208/6; 208/7; 208/42; 208/50; 208/92; 208/130

(58) Field of Classification Search ..... 208/42, 208/45, 102, 130, 6, 7, 50, 67, 92
See application file for complete search history.

(56) References Cited

U.S. PATENT DOCUMENTS

| | | | |
|---|---|---|---|
| 2,633,449 | A | 3/1953 | Cheney |
| 3,240,695 | A | 3/1966 | Hamner et al. |
| 3,413,211 | A | 11/1968 | Becraft et al. |
| 3,501,400 | A | 3/1970 | Brody |
| 3,617,493 | A | 11/1971 | Wirth et al. |
| 3,622,502 | A | 11/1971 | Mason et al. |
| 3,691,058 | A | 9/1972 | Hamner et al. |

(Continued)

FOREIGN PATENT DOCUMENTS

| | | |
|---|---|---|
| BE | 889974 | 1/1981 |

(Continued)

OTHER PUBLICATIONS

Van Dongen et al.; "The Application of Gas/Liquid Cyclones in Oil Refining"; Jan. 1958; Transactions of the ASME; pp. 245-251.

*Primary Examiner* — Walter D Griffin
*Assistant Examiner* — Renee E Robinson

(57) ABSTRACT

The invention is directed to a process wherein a feedstock or stream comprising steam cracker tar is passed to a vacuum pipestill. A deasphalted cut of tar is obtained as an overhead (or sidestream) and a heavy tar asphaltenic product is obtained as bottoms. In preferred embodiments, at least a portion of the bottoms product is sent to a partial oxidation unit (POX) wherein syn gas may be obtained as a product, and/or at least a portion of the bottoms product is used to produce a light product stream in a coker unit, such as coker naphtha and/or or coker gas oil. In another preferred embodiment at least a portion of the overheads product is added to refinery fuel oil pools and in yet another preferred embodiment at least a portion of the overheads product is mixed with locally combusted materials to lower soot make. Two or more of the aforementioned preferred embodiments may be combined.

16 Claims, 1 Drawing Sheet

U.S. PATENT DOCUMENTS

| | | | | |
|---|---|---|---|---|
| 3,707,459 | A | 12/1972 | Mason et al. | |
| 3,941,681 | A | 3/1976 | Saegusa et al. | |
| 3,956,101 | A | 5/1976 | Hara et al. | |
| 3,998,726 | A | 12/1976 | Bunas et al. | |
| 4,086,156 | A | 4/1978 | Dickakian | |
| 4,140,212 | A | 2/1979 | O'Blasny et al. | |
| 4,207,168 | A | 6/1980 | Simone | |
| 4,219,404 | A | 8/1980 | Dickakian | |
| 4,261,814 | A | 4/1981 | Pfeifer | |
| 4,264,334 | A | 4/1981 | Durand et al. | |
| 4,309,271 | A | 1/1982 | Dorner | |
| 4,363,715 | A | 12/1982 | Dickakian | |
| 4,414,095 | A | 11/1983 | Dickakian | |
| 4,431,512 | A | 2/1984 | Dickakian | |
| 4,435,274 | A | 3/1984 | Juguin et al. | |
| 4,446,002 | A | 5/1984 | Siegmund | |
| 4,548,704 | A | 10/1985 | Dickakian | |
| 4,705,618 | A | 11/1987 | Tsuchitani et al. | |
| 4,721,557 | A | 1/1988 | Staggs | |
| 4,770,747 | A | 9/1988 | Muller | |
| 5,215,649 | A | 6/1993 | Grenoble et al. | |
| 5,358,627 | A | 10/1994 | Mears et al. | |
| 5,443,715 | A | 8/1995 | Grenoble et al. | |
| 5,489,374 | A | 2/1996 | Romine et al. | |
| 5,785,860 | A | 7/1998 | Smith | |
| 5,976,361 | A | 11/1999 | Hood et al. | |
| 6,241,874 | B1 | 6/2001 | Wallace et al. | |
| 6,533,925 | B1 * | 3/2003 | Wallace et al. | 208/309 |
| 6,632,351 | B1 | 10/2003 | Ngan et al. | |
| 7,560,020 | B2 | 7/2009 | Annamalai et al. | |
| 7,713,636 | B2 | 5/2010 | Song et al. | |
| 2004/0004022 | A1 * | 1/2004 | Stell et al. | 208/106 |
| 2004/0232047 | A1 | 11/2004 | Benazzi et al. | |
| 2005/0261530 | A1 * | 11/2005 | Stell et al. | 585/648 |
| 2006/0272982 | A1 | 12/2006 | Montanari et al. | |
| 2007/0007170 | A1 | 1/2007 | Strack et al. | |
| 2007/0278328 | A1 * | 12/2007 | Bartolini et al. | 239/427 |
| 2008/0116109 | A1 | 5/2008 | McCoy et al. | |

FOREIGN PATENT DOCUMENTS

| | | |
|---|---|---|
| CA | 1069846 | 1/1980 |
| DE | 3227490 | 7/1987 |
| EP | 0021708 | 1/1981 |
| EP | 0056338 | 7/1982 |
| EP | 0 067 581 | 12/1982 |
| EP | 0086607 | 8/1983 |
| EP | 0 100 198 | 2/1984 |
| EP | 0100198 | 2/1984 |
| EP | 0067581 | 11/1985 |
| EP | 0 250 136 | 12/1987 |
| EP | 0243509 | 8/1990 |
| EP | 0791040 | 8/1997 |
| FR | 2510133 | 1/1983 |
| GB | 1 298 098 | 11/1972 |
| GB | 2014605 | 8/1979 |
| GB | 1601644 | 11/1981 |
| GB | 2104544 | 3/1983 |
| JP | 52-81321 | 7/1977 |
| JP | 58149991 | 9/1983 |
| JP | 61-98794 | 5/1986 |
| WO | WO 91/13951 | 9/1991 |
| WO | WO 91/17230 | 11/1991 |
| WO | WO 93/12200 | 6/1993 |
| WO | 2006/066857 | 6/2006 |

* cited by examiner

UPGRADING OF TAR USING POX/COKER

RELATED APPLICATIONS

This application claims benefit of and priority to U.S. provisional patent application Ser. No. 60/841,657, filed Aug. 31, 2006, the entirety of which is incorporated herein by reference.

FIELD OF THE INVENTION

The invention relates to upgrading of tar (pyrolysis fuel oil) to produce deasphalted tar from steam cracked tar.

BACKGROUND OF THE INVENTION

Steam cracking, also referred to as pyrolysis, has long been used to crack various hydrocarbon feedstocks into olefins. Conventional steam cracking utilizes a pyrolysis furnace wherein the feedstock, typically comprising crude or a fraction thereof optionally desalted, is heated sufficiently to cause thermal decomposition of the larger molecules. Steam is typically added to the pyrolysis furnace inter alia to reduce hydrocarbon partial pressure, to control residence time, and to minimize coke formation. Among the valuable and desirable products obtained from the furnace include light olefins such as ethylene, propylene, and butylenes. The pyrolysis process, however, also produces molecules that tend to combine to form high molecular weight materials known as steam cracked tar or steam cracker tar ("SCT"), sometimes referred to as pyrolysis fuel oil. Typically tar, as well as steam cracked gas oil ("SCGO") is recovered as bottoms product in the first fractionator after the steam cracker. These are among the least valuable products obtained from the effluent of a pyrolysis furnace. In general, feedstocks containing higher aromatic boiling materials ("heavy feeds") tend to produce greater quantities of SCT.

SCT is among the least desirable of the products of pyrolysis since it finds few uses. SCT tends to be incompatible with other "virgin" (meaning it has not undergone any hydrocarbon conversion process such as FCC or steam cracking) products of the refinery pipestill upstream from the steam cracker. At least one reason for such incompatibility is the presence of asphaltenes. Asphaltenes are very high in molecular weight and precipitate out when blended in even insignificant amounts into other materials, such as fuel oil streams.

The increasing use of lower quality crude feeds to the refinery, i.e., heavier, and more aromatic and/or higher sulfur feeds, has increased the amount of tar produced and, in the case of higher sulfur feeds, increased the difficulty of disposing of it. While tar has always been difficult to dispose of, the tar obtained from these heavy and/or high sulfur feeds is less compatible with refinery fuel oil pools and the typically higher sulfur levels render it unacceptable for burning.

One way to avoid production of SCT is to limit conversion of the pyrolysis feed, but this also reduces the amount of valuable products such as light olefins. Another solution is to "flux" or dilute SCT with stocks that do not contain asphaltenes, but this also requires the use of products that find higher economic value in other uses.

Certain methods of upgrading tar have been proposed in the prior art, but these methods are inefficient and/or do not provide sufficient volume of disposal of low value tar. For instance, U.S. Pat. No. 4,207,168 teaches making needle coke from pyrolysis fuel oil by separating quinoline insolubles and asphaltenes from the fuel oil and subjecting the remaining portion to coking.

In the disclosure of U.S. Pat. No. 4,309,271, hydrocarbons are subjected to hydrogenation and, after separation of the product into liquid and gaseous fractions, the liquid fraction is cracked and fractionated. A polymer free fraction of the residue is returned to the feedstock and to the hydrogenation stage, and a heavy residue component of the initial liquid fraction partially oxidized with the residue.

GB 2 014 605 treats pyrolysis fuel oil produced during the production of olefins by thermal cracking by first subjecting it to solvent extraction to remove "polymeric compounds". The treated material is said to exhibit "essential differences" from asphaltenes obtained from petroleum fractions (i.e., refinery operations). The polymer-free portion constitutes a material said to be useful as a fuel oil. The polymeric components, precipitated in solid form, are said to be useful in the production of adhesives or in road building.

GB 2 104 544 discloses treating pyrolysis tar obtained from the production of ethylene from naphtha feeds via steam cracking by first heating the feedstock with hydrogen to saturate polynuclear aromatic compounds, then hydrocracking the hydrogenated compounds in a cracking zone to obtain an effluent from the cracking zone which may be separated into a gaseous and liquid product.

U.S. Pat. No. 4,548,704 relates to making pitch suitable for spinning into carbon fibers, the pitch being derived from a deasphaltenated middle fraction of a feedstock.

Since at least the early 1980s, the bottoms of the primary fractionator downstream of a pyrolysis furnace has been fed to a vacuum tower, resulting in the production of a heavy tar asphaltenic product. However, the quantity of this heavy tar asphaltenic product was very small and could be readily disposed of by blending, optionally with a fluxant, into various fuel oil pools such as Bunker fuels, or by local combustion to generate steam. However, SCT is now being generated in amounts beyond the capacity of current technology to be efficiently utilized, because of the general incompatibility of steam cracker tar, even relatively low asphaltene steam cracker tar, with fuel oil pools such as Bunker C fuel oil and onsite tar burning in site boilers, and alternative to blending used to avoid tar separation investment, is generally precluded by tighter emission regulations increasingly limit the amount that can be burned for this purpose.

In U.S. Pat. No. 4,140,212, a distillation tower is described including a tangential inlet and cooperating internal baffles for creating a whirling flow pattern, with a means for recovery of hydrocarbons from waste oil introduced to the tower through the tangential inlet.

The present inventors have discovered that vacuum pipestill bottoms product using tar as the feed may be efficiently used in a POX and/or Coker unit and also that adaptation of the aforementioned VPS tower entrainment technology in an integrated system comprising a pyrolysis furnace provides an efficient method of reducing or eliminating the problem of disposal of steam cracker tar.

SUMMARY OF THE INVENTION

The invention is directed to a process wherein a feedstock or stream comprising steam cracker tar is passed to a vacuum pipestill. A deasphalted cut of tar is obtained as an overhead (or sidestream) and a heavy tar asphaltenic product is obtained as bottoms, and wherein at least a portion of the bottoms product is sent to a partial oxidation unit (POX) wherein, in a preferred embodiment, Syn Gas is obtained as a product, and/or at least a portion of the bottoms product is used to produce a light product stream in a coker unit, said light product stream including, in preferred embodiments, as coker naphtha and/or or coker gas oil.

In another preferred embodiment at least a portion of the overheads product is added to refinery fuel oil pools and in yet another preferred embodiment at least a portion of the overheads product is mixed with locally combusted materials to lower soot make.

Two or more of the aforementioned preferred embodiments may be combined.

In a more preferred embodiment, the invention comprises a process for producing deasphalted steam cracker tar comprising feeding steam cracker tar to a vacuum pipestill and obtaining as an overheads a deasphalted tar product and as a bottoms an asphaltenic heavy tar product, wherein at least a portion of the bottoms product is passed to at least one of (a) a POX unit to produce a product comprising Syn Gas, and (b) a coker unit to produce a product comprising at least one material selected from coker naphtha and coker gas oil. In another embodiment, a process comprises: a step of thermal cracking of a feedstock in a pyrolysis furnace to provide a product comprising light olefins selected from ethylene, propylene, and butenes, and tar; a step of deasphalting said tar in a vacuum pipestill to provide a deasphalted tar; then a step of (a) passing at least a portion of said deasphalted tar to a POX unit to obtain a product comprising Syn Gas; or (b) passing at least a portion of said deasphalted tar to a coker unit to obtain a product comprising coker naphtha and/or coker gas oil; or (c) both (a) and (b).

The invention is also directed to an integrated system comprising a pyrolysis furnace, a primary fractionator fluidly connected with the outlet of said furnace, a vacuum pipestill fluidly connected with the bottoms of said primary fractionator, whereby steam cracker tar is separated in said vacuum pipestill into a deasphalted tar overheads and a heavy tar asphaltenic bottoms product, and wherein the bottoms of said vacuum pipestill is fluidly connected to at least one of a POX unit and a coker unit, whereby said heavy tar asphaltenic bottoms product is upgraded.

It is an object of the invention to upgrade tar fractions by separating steam cracked tar into fractions including a heavy tar asphaltenic bottoms, which may be treated in a POX and/or coker unit.

It is further an object of the invention to reduce or eliminate the need to dispose of low value tar by means of the present invention.

These and other objects, features, and advantages will become apparent as reference is made to the following detailed description including the drawing, preferred embodiments, examples, and appended claims.

DETAILED DESCRIPTION

Figure 1:
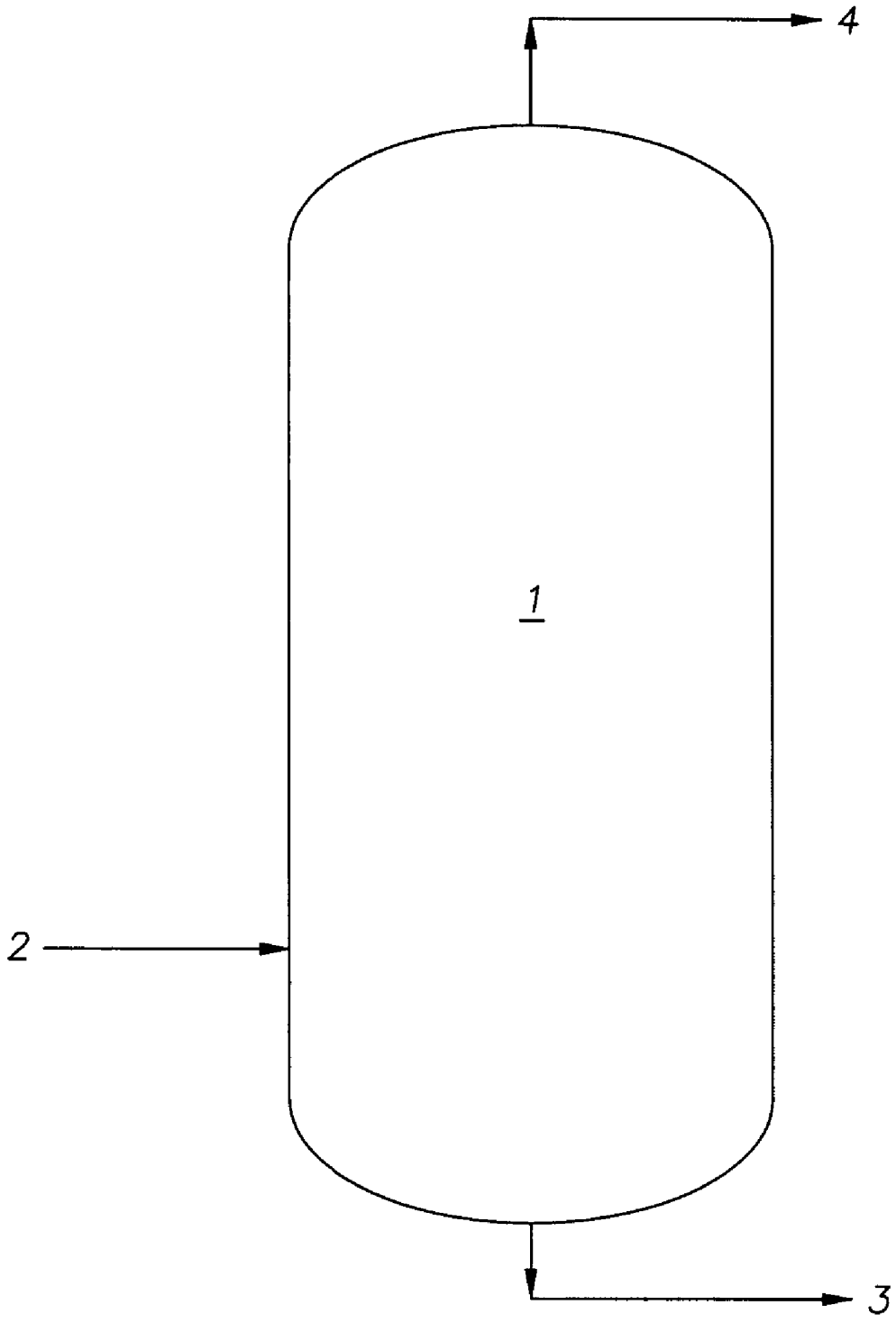
FIG. 1 is a process flow diagram illustrating a portion of an embodiment of the invention.

According to the invention steam cracker tar is treated by a method comprising feeding steam cracker tar to a vacuum pipestill (VPS), wherein it is separated into various fractions including an overhead comprising a deasphalted tar product and as a bottoms product a heavy tar asphaltenic product, the latter being upgraded in a POX and/or coker unit.

The invention also concerns an integrated system comprising, in series and in fluid connection, a pyrolysis furnace, a primary fractionator whereby tar is obtained as a bottoms product, a vacuum pipestill, and at least one of a POX unit and a coker unit.

Crude, as used herein, means whole crude oil as it issues from a wellhead, optionally including a step of desalting and/or other steps as may be necessary to render it acceptable for conventional distillation in a refinery. Crude as used herein is presumed to contain resid unless otherwise specified.

The terms thermal pyrolysis unit, pyrolysis furnace, steam cracker and steamcracker are used synonymously herein; all refer to what is conventionally known as a steam cracker, even though steam is optional.

The term vacuum pipestill (or vacuum pipe still), vacuum tower, and "VPS" are also used synonymously herein, and include apparatus per se well known in refining operations.

The term "POX" means a partial oxidation and POX unit as used herein refers to the apparatus within which the partial oxidation occurs. The term "coking" or "delayed coking" refers to a thermal cracking process by which a heavy material is converted into lighter material and coke and the coking unit refers to the apparatus within which the coking occurs. Both process and apparatus terms are well known per se in refining.

In the present invention, partial oxidation reacts the hydrocarbon feed from the vacuum pipestill with oxygen at high temperatures to produce a mixture of hydrogen and carbon monoxide (Syn Gas). While the conditions of partial oxidation are not critical and can be determined by one of ordinary skill in the art, for the present invention preferred conditions include a temperature of about 1455° C. (±50° C.) and pressure of about 870 psig (±25 psig), measured at the reactor inlet. The $H_2$ and CO yields will vary according to conditions but in preferred embodiments will be in the range of about 0.98 to $1.8H_2/CO$, which may be achieved without undue experimentation by one of ordinary skill in the art in possession of the present disclosure. The Syn Gas is preferably used to make alcohols in integration with the well-known Oxo Process, or to make fuel, or to make a hydrogen rich product, or a combination of these uses.

In the present invention, coking converts the hydrocarbon feed from the vacuum pipestill to in the coker unit to coker naphtha and coker gas oil as overheads/sidestreams and coke as a bottoms product. In the present invention, the apparatus used may be a typical coker used in refinery processing, which in refining process converts residual oil from the crude unit vacuum or atmospheric column into gas oil. The process of coking or delayed coking is a semi-continuous thermal cracking process which can be broken down to three distinct stages. The feed undergoes partial vaporization and mild cracking as it passes through the coking furnace. The vapours undergo cracking as they pass through the coke drum to fractionation facilities downstream. In a refinery the typical products of gas, naphtha, jet fuel and gas oil are separated in the fractionation facilities. According to the present invention, the products comprise coker naphtha and coker gas oil separated in the fractionation facilities; the petroleum coke remains in the drum. The heavy hydrocarbon liquid trapped in the coke drum is subjected to successive cracking and polymerization until it is converted to vapours and coke.

While appropriate coker conditions may be determined without undue experimentation by one of ordinary skill in the art in possession of the present disclosure, preferred conditions include a temperature of about 450° C. to 550° C. and pressure of about 15-25 psig, measured at the reactor inlet. Coke resulting from a low sulfur feed may be used for needle coke or anode coke. More generally, the coke produced by the process of the invention may be used for fuel.

"Tar" or steam cracker tar (SCT) as used herein is also referred to in the art as "pyrolysis fuel oil". The terms will be used interchangeably herein. The tar will typically be obtained from the first or primary fractionator downstream from the steam cracker as the bottoms product of the fractionator, nominally having a boiling point of 550° F.+(288° C.+) and higher.

In a preferred embodiment, SCT is obtained as a product of a pyrolysis furnace wherein additional products include a vapor phase including ethylene, propylene, butenes, and a liquid phase comprising C5+ species, having a liquid product distilled in a primary fractionation step to yield an overheads comprising steam-cracked naphtha fraction (e.g., C5-C10 species) and steam cracked gas oil (SCGO) fraction (i.e., a boiling range of about 400° F. to 550° F., e.g., C10-C15/C17 species), and a bottoms fraction comprising SCT and having a boiling range above about 550° F., e.g., C15/C17+ species).

The term "asphaltene" as used herein means a material obtainable from crude oil and having an initial boiling point above 1200° F. (650° C.) and which is insoluble in a paraffinic solvent.

The feed to the pyrolysis furnace may comprise crude (such as a high sulfur containing virgin crude rich in polycyclic aromatics which has been desalted), or a crude fraction thereof (such as may be obtained from an atmospheric pipestill (APS) or vacuum pipestill (VPS) of a type per se well-known in the art, or typically a combination of APS followed by VPS treatment of the APS bottoms). The crude and/or fraction thereof is optionally but preferably desalted prior to being provided to the pyrolysis furnace. In general the operating conditions of such a furnace, which may be a typical pyrolysis furnace such as known per se in the art, can be determined by one of ordinary skill in the art in possession of the present disclosure without more than routine experimentation. Typical conditions will include a radiant outlet temperature of between 760° C.-880° C., a cracking residence time period of 0.01 to I sec, and a steam dilution of 0.2 to 4.0 kg steam per kg hydrocarbon.

It is preferred that the furnace have a vapor/liquid separation device (sometimes referred to as flash pot or flash drum) integrated therewith, such as disclosed and described in U.S. Patent Applications 2004/0004022; 2004/0004027; 2004/0004028; 2005/0209495; 2005/0261530; 2005/0261531; 2005/0261532; 2005/0261533; 2005/0261534; 2005/0261535; 2005/0261536; 2005/0261537; and 2005/0261538. Another preferred vapor/liquid separation device is described in U.S. Pat. No. 6,632,351. In a preferred embodiment using a vapor/liquid separation device, the composition of the vapor phase leaving the device is substantially the same as the composition of the vapor phase entering the device, and likewise the composition of the liquid phase leaving the flash drum is substantially the same as the composition of the liquid phase entering the device, i.e., the separation in the vapor/liquid separation device consists essentially of a physical separation of the two phases entering the drum.

In embodiments using a vapor/liquid separation device integrated with the pyrolysis furnace, a feedstream is provided to the inlet of a convection section of a pyrolysis unit, wherein it is heated so that at least a portion of the feedstream is in the vapor phase. Steam is optionally but preferably added in this section and mixed with the feedstream. The heated feedstream with optional steam and comprising a vapor phase and a liquid phase is then flashed in the vapor/liquid separation device to drop out the heaviest fraction (e.g., asphaltenes). In still more preferred embodiments the vapor/liquid separation device integrated with the pyrolysis furnace operates at a temperature of from about 800° F. (about 425° C.) to about 850° F. (about 455° C.). The overheads from the vapor/liquid separation device are then introduced via crossover piping into the radiant section where the overheads are quickly heated, such as at pressures ranging from about 10 to 30 psig, to a severe hydrocarbon cracking temperature, such as in the range of from about 1450° F. to 1550° F., to provide cracking of the feedstream.

One of the advantages of having a vapor/liquid separation device downstream of the convection section inlet and upstream of the crossover piping to the radiant section is that it increases the feedstreams available to be used directly, without pretreatment, as feed to a pyrolysis furnace. Thus, crude oil, even high naphthenic acid containing crude oil and fractions thereof, may be used directly as feed. Feeds having a high naphthenic acid content are among those that produce a high quantity of tar and are especially suited to be advantageously used as feed to the pyrolysis furnace according to the process of the present invention. Preferred feeds to the pyrolysis furnace will include gas oil, vacuum gas oil, crude oil, crude oil residues. It is especially preferred that when the feed comprises greater than about 0.1 wt %, or preferably greater than about 5.0 wt % asphaltenes, a vapor liquid separation device, which may optionally be integrated with the pyrolysis furnace, is advantageously used to remove at least a portion of asphaltenes in the feed prior to entering the radiant section of the pyrolysis unit, such as described in US Applications 2004/0004022; 2004/0004027; 2004/0004028; 2005/0209495; 2005/0261530; 2005/0261531; 2005/0261532; 2005/0261533; 2005/0261534; 2005/0261535; 2005/0261536; 2005/0261537; and 2005/0261538. In this preferred vapor liquid separation device integrated with a pyrolysis furnace or "integrated vapor liquid separation device", feedstock is provided to the convection section of the pyrolysis furnace, whereby at least a portion of the feedstock is vaporized, followed subsequently by passing the at least partially vaporized feedstock, optionally with steam, to a flash drum, wherein a vapor phase and liquid phase are separated. The vapor phase is fed to the radiant section of a pyrolysis furnace, and products, including desirable light olefins, are obtained as effluent of the furnace. Preferred feeds have up to about 5 wt % sulfur in the feed. The present invention is advantageously applied to the case where the feed to the pyrolysis furnace comprises high amounts of aromatic sulfur, most of which ends up in the steam cracker tar product (typically at sulfur concentrations about 3 to 4 times higher in the tar than in the feed, by weight).

The feed comprising crude or fraction thereof is converted in the pyrolysis furnace, optionally having a vapor/liquid separator as described above, at an elevated temperature to cracked products. The hot cracked gas may be quenched or passed at substantially the elevated temperature of the furnace into a pyrolysis fractionating column, also referred to as the first or primary fractionator or fractionating column. Within the fractionating column, the cracked products are separated into a plurality of fractionation streams including 12, methane, higher alkanes, and olefins such as ethylene, propylene, butenes, which are recovered from the fractionating column as overheads or sidestreams, along with a bottoms product comprising tar and steam cracked gas oil (SCGO). Typically this residue material will have a boiling point above about 400° F. (It should be noted that boiling points given herein are to be taken at atmospheric conditions unless another pressure condition is indicated) This material is sent to the vacuum pipestill according to the present invention.

The vacuum pipestill (VPS) may be of the type per se well known in the art. For instance, it may be the same type of VPS as used in refinery operations, which will typically contain an entry for feed, the feed being tar in the present invention, a conventional stripping zone (with at least one entry for stripping stream, if used) and a flash zone, such as described in U.S. Pat. No. 4,261,814. Conventionally the VPS has one or more take-off lines for one or more lighter fractions and a bottoms product. Subatmospheric pressure may be maintained, for instance, by one or more stages of ejectors.

The present invention, with respect to a preferred embodiment of the vacuum tower operations, will now be discussed with reference to FIG. 1. In FIG. 1, tar from the primary fractionator downstream of the pyrolysis furnace enters near the bottom of vacuum tower 1 through conduit 2. In a preferred embodiment conduit 2 enters into a flash zone below the tower trays (not shown). Vacuum tower 1 is operated at subatmospheric pressure, such as from about 0.1 to 80 psig and 650° F. to 900° F., preferably at about 0.5 to 2 psia and 700° F. to 850° F., measured at the inlet of conduit 2 into the vacuum tower 1. Heavy tar asphaltenic product, having in this embodiment an atmospheric boiling point of 1000° F.+, is taken off through bottoms conduit 3 and the deasphalted tar product is taken off as overheads through conduit 4. In embodiments one or more sidestreams may also be taken off (not shown).

In a preferred embodiment the overheads 4 may be blended with mogas, an upper sidestream (not shown) comprises distillate (diesel) and a lower sidestream (not shown) comprises fuel oil.

Still another preferred fractionation apparatus is described in copending, commonly assigned, U.S. Provisional Application Ser. No. 60/841,597, filed Aug. 31, 2006, utilizing a vacuum pipestill (VPS) including a flash zone separated from a zone comprising trays by at least one annular ring or entrainment device and obtaining as an overheads a deasphalted tar product, which is sent to the hydrotreater according to the present invention, and as a bottoms an asphaltenic heavy tar product, which may be blended with fuel oil. The annular ring defines a ceiling which blocks upward passage of vapor/liquid mixtures along the circular wall beyond the ceiling section, and surrounds an open core having sufficient cross-sectional area to permit vapor velocity low enough to avoid significant entrainment of liquid. The use of an annular entrainment device in a distillation tower has been described per se in U.S. Pat. No. 4,140,212 and also U.S. Application Publication Nos. 2004/0004028; 2005/0261530; 2006/0089519; WO 2004/005431; and WO 2005/113715, and by Van Dongen and Ter Linden for oil refining in Transactions of the ASME, January 1958, pp. 245-251. Any of the annular entrainment devices discussed in these references may be used in the VPS to provide the deasphalted tar according to the present invention.

According to the present invention, at least a portion of the heavy tar asphaltenic bottoms product is sent to at least one of a partial oxidation unit (POX) or coker unit. Both of these devices are per se well known refinery apparatus not traditionally found in chemical operations downstream of a pyrolysis unit. Accordingly, chemical operations may be integrated with refinery operations by, for instance: (1) feeding tar from the pyrolysis furnace's primary fractionator into a refinery VPS which is also (simultaneously or in batch operations) fed from the refinery APS; (2) integration by having the heavy tar asphaltenic bottoms from the chemical plant VPS downstream from the pyrolysis furnace feed into (a) the refinery coker and/or (b) POX apparatus, either of which may also be fed from the refinery VPS, or a combination of these possible integrations.

Products of the heavy tar asphaltenic product from the coker unit include coker naphtha which may be blended to mogas and coker gas oil which may be blended with diesel and/or heavy fuel oil.

Products of the heavy tar asphaltenic product from POX unit include syn gas (CO and $H_2$), which find numerous highly valuable chemical applications such as in oxo alcohol production and methanol production.

Overheads and/or side streams have numerous uses upgrades from tar, such as disposition to refinery fuel oil pools, with which it is compatible in all proportions without the necessity of the addition of fluxant.

In preferred embodiments, the aforementioned deasphalted product is blended with heavy fuel oils and/or Bunker fuels. Typical specifications are provided below for an RSFO blend meeting the 380 centistoke (cSt) requirements for Fuel Oil is given below. For a composition according to the present invention, the most important specifications (with regard to meeting the various specifications for published fuel oil requirements) are Kinematic Viscosity (KV), Specific Gravity (SG) and compatibility (e.g., one or both of the sediment criteria listed below). It is an important and surprising discovery of the present inventors that such specifications can be met for a mixture containing the deasphalted product obtained according to the present invention and refinery fuel oil pools. One such typical specification is listed in Table 1 below.

TABLE 1

(RFSO) Standard Fuel Oil Specifications in Singapore (Platt's)

| Property | 380 cSt Fuel Oil |
|---|---|
| Sulfur Max | 4.0% |
| Kinematic Vis @50 deg C. Max [ASTM D445] | 380 cSt |
| SG @15 C. deg C. Max | 0.991 |
| Flash Point Min | 66° C. |
| Pour Point Max | 24° C. |
| Ash on a weight basis Max | 0.10% |
| Conradson Carbon Residue (CCR) Max | 18% |
| Vanadium Max | 200 ppm |
| Sodium Max | 100 ppm |
| Aluminium + Silicon Max | 80 ppm |
| Water by distillation volume Max | 0.50% |
| Sediment by extraction Max | 0.10% |
| Total existent sediment | 0.10% |

Without wishing to be bound by theory, the present inventors believe have provided a novel process whereby tar obtained from chemical steam cracking apparatus may be upgraded using principles derived from refinery operations which, it is believed, have heretofore not been applied to low value products produced by steam crackers.

Trade names used herein are indicated by a ™ symbol or ® symbol, indicating that the names may be protected by certain trademark rights, e.g., they may be registered trademarks in various jurisdictions.

All patents and patent applications, test procedures (such as ASTM methods, UL methods, and the like), and other documents cited herein are fully incorporated by reference to the extent such disclosure is not inconsistent with this invention and for all jurisdictions in which such incorporation is permitted.

When numerical lower limits and numerical upper limits are listed herein, ranges from any lower limit to any upper limit are contemplated. While the illustrative embodiments of the invention have been described with particularity, it will be understood that various other modifications will be apparent to and can be readily made by those skilled in the art without departing from the spirit and scope of the invention.

The invention has been described above with reference to numerous embodiments and specific examples. Many variations will suggest themselves to those skilled in this art in light of the above detailed description. All such obvious variations are within the full intended scope of the appended claims, including, by way of preferred examples which are not intended to be limiting.

What is claimed is:

1. A process for producing deasphalted steam cracker tar comprising feeding a stream containing greater than 5.0 wt % asphaltenes to a pyrolysis furnace, steam cracking said stream to form cracked products and steam cracker tar, feeding a stream comprising said steam cracker tar to a vacuum pipestill (VPS) and obtaining as an overheads a deasphalted tar product and as a bottoms an asphaltenic heavy tar product having a boiling point of 538° C.+, wherein at least a portion of said bottoms product is passed to a POX unit preferably to produce a product comprising Syn Gas.

2. The process of claim 1, wherein said VPS process conditions include a temperature of 371° C.-455° C. and a pressure of from about 3.4 to about 13.8 kPa.

3. The process of claim 1, wherein said VPS overheads comprise a cut having a boiling point of from about 288° C. to about 538° C.

4. The process of claim 1, wherein at least a portion of said deasphalted tar product is mixed with heavy fuel oils and/or Bunker fuels.

5. The process of claim 1, wherein said steam cracker tar is obtained from said pyrolysis furnace having an integrated vapor liquid separation device.

6. The process of claim 5, wherein the feed to said pyrolysis furnace is selected from the group consisting of whole crude optionally desalted, atmospheric resid, and mixtures thereof.

7. The process of claim 1, wherein at least a portion of said bottoms product is passed to a POX unit integrated with a refinery VPS and/or APS.

8. The process of claim 1, wherein at least a portion of said bottoms product is passed to a coker unit integrated with a refinery VPS and/or APS.

9. The process of claim 1, wherein at least a portion of said bottoms product is passed to a coker unit to produce coker naphtha and then blending said coker naphtha with mogas.

10. The process of claim 1, wherein at least a portion of said bottoms product is passed to a coker unit to produce coker gas oil and then blending said coker gas oil with diesel and/or heavy fuel oil.

11. The process of claim 1, wherein at least a portion of said deasphalted tar product is blended with a refinery fuel oil pool to create a blend meeting at least one Standard Fuel Oil Specification.

12. The process of claim 1, wherein said vacuum pipestill comprise an annular ring separating a flash zone and a zone having distillation trays, said annular ring defining a ceiling which blocks upward passage of vapor/liquid mixtures along the circular wall beyond the ceiling section, and surrounds an open core having sufficient cross-sectional area to permit vapor velocity low enough to avoid significant entrainment of liquid.

13. A process for producing Syn Gas comprising steam cracking a feed containing greater than 5.0 wt % asphaltenes to form cracked products and steam cracker tar, feeding said steam cracker tar to a vacuum pipestill and obtaining as bottoms product an asphaltenic heavy tar product having a boiling point of 538° C.+, and then passing said asphaltenic heavy tar product to a POX unit and oxidizing said asphaltenic heavy tar product under conditions sufficient to produce $H_2$ and CO in a ratio of about 0.98 to 1.8$H_2$/CO, said conditions including a temperature of about 1455° C. (+/−50° C.) and pressure of about 6.0 MPa (+/−172 kPa), measured at the reactor inlet.

14. A process for producing coker naphtha and/or coker gas oil comprising steam cracking a feed containing greater than 5.0 wt % asphaltenes to form cracked products and steam cracker tar, feeding steam cracker tar to a vacuum pipestill and obtaining as a bottoms product an asphaltenic heavy tar product having a boiling point of 538° C.+, then passing said asphaltenic heavy tar product to a coker unit and processing said asphaltenic heavy tar product under conditions sufficient to produce coker naphtha and/or coker gas oil, said conditions including a temperature of about 450° C. to 550° C. and pressure of about 207-276 kPa, wherein said vacuum pipestill comprises an annular ring separating a flash zone and a zone having distillation trays, said annular ring defining a ceiling which blocks upward passage of vapor/liquid mixtures along the circular wall beyond the ceiling section, and surrounds an open core having sufficient cross-sectional area to permit vapor velocity low enough to avoid significant entrainment of liquid.

15. A process comprising:

thermal cracking of a feedstock containing greater than 5.0 wt % asphaltenes in a pyrolysis furnace to provide a product comprising light olefins selected from ethylene, propylene, and butenes, and tar;

deasphalting said tar in a vacuum pipestill to provide a deasphalted tar; and performing at least one of: (a) passing at least a portion of said deasphalted tar to a POX unit to obtain a product comprising Syn Gas; and (b) passing at least a portion of said deasphalted tar to a coker unit to obtain a product comprising coker naphtha and/or coker gas oil and passing another at least a portion of said deasphalted tar to a POX unit to obtain a product comprising Syn Gas.

16. The process of claim 15, said process characterized by at least one of the following:

wherein said pyrolysis furnace is characterized by an integrated vapor liquid separation device; and wherein said vacuum pipestill is characterized by an annular ring separating a flash zone and a zone having distillation trays, said annular ring defining a ceiling which blocks upward passage of vapor/liquid mixtures along the circular wall beyond the ceiling section, and surrounds an open core having sufficient cross-sectional area to permit vapor velocity low enough to avoid significant entrainment of liquid.

* * * * *